United States Patent [19]

Ball et al.

[11] 4,019,740

[45] Apr. 26, 1977

[54] BOARD GAMES

[75] Inventors: John Anthony Ball; Keith Arthur Warburton, both of Basingstoke, England; Raymond Donald Carew, Edinburgh, Scotland

[73] Assignee: John Anthony Ball, Basingstoke, England

[22] Filed: Sept. 10, 1975

[21] Appl. No.: 611,883

[30] Foreign Application Priority Data

Sept. 16, 1974 United Kingdom ..... 40198/74

[52] U.S. Cl. ..... 273/131 KN

[51] Int. Cl.[2] ..... A63F 3/00

[58] Field of Search ..... 273/131

[56] References Cited

UNITED STATES PATENTS

| | | | |
|---|---|---|---|
| 809,502 | 1/1906 | Hale | 273/131 B |
| 1,030,970 | 7/1912 | Brunello | 273/131 R |
| 3,870,311 | 3/1975 | Klupp | 273/131 AB |
| 3,897,953 | 8/1975 | Hornanian | 273/131 AB |

*Primary Examiner*—Delbert B. Lowe

*Attorney, Agent, or Firm*—Fleit & Jacobson

[57] ABSTRACT comprises a board which has a playing area divided into playing spaces and respective similar armies of pieces which may be moved about the playing area by the players to capture opposing pieces. Each player is provided with one or more non-playing areas adapted to accommodate one of his playing pieces and with a marker adapted to be accommodated on a playing space, whereby either player can remove one of his playing pieces from the playing area and denote the playing space from which it was removed by positioning his marker on that playing space.

11 Claims, 12 Drawing Figures

BOARD GAMES

BACKGROUND OF THE INVENTION

This invention relates to a board game for two players comprising a board having a playing area divided into playing spaces, and two similar armies of playing pieces for positioning on said playing spaces and for movement about said playing area by the players whereby each player may take pieces of the other player's army.

Chess is a well-known example of a game of the above type, and is a simulation of a war situation in which two armies confront one another.

It is an object of this invention to provide a board game of the above type in which the players' skill is taxed by the addition to the game of an extra dimension.

SUMMARY OF THE INVENTION

The inventive game represents a purely imaginary military situation in which two armies confront one another in time as well as in space. Each player is provided with a non-playing area, which may be a circle, and with a marker. To simulate the purely imaginary departure in time of a playing piece from the situation, the piece is removed from the playing area and the marker is positioned in the playing space from which the piece was removed. The purely imaginary operation of departure in time of a playing piece will hereinafter be referred to as a "time-warp" operation, a playing piece being considered to be in a purely imaginary "time-warp" situation while it is removed from the playing area. The piece can thereafter return from time-warp at a tactically advantageous moment by being replaced on the space from which it was removed or on a space having a prescribed positional relationship to the square from which the piece was removed.

BRIEF DESCRIPTION OF THE DRAWINGS

By way of example only, and without restricting the scope of the invention as defined by the appended claims, a preferred board game in accordance with the invention will now be described with reference to the accompanying drawings, in which:

DETAILED DESCRIPTION OF PREFERRED EMBODIMENT

Figure 1:
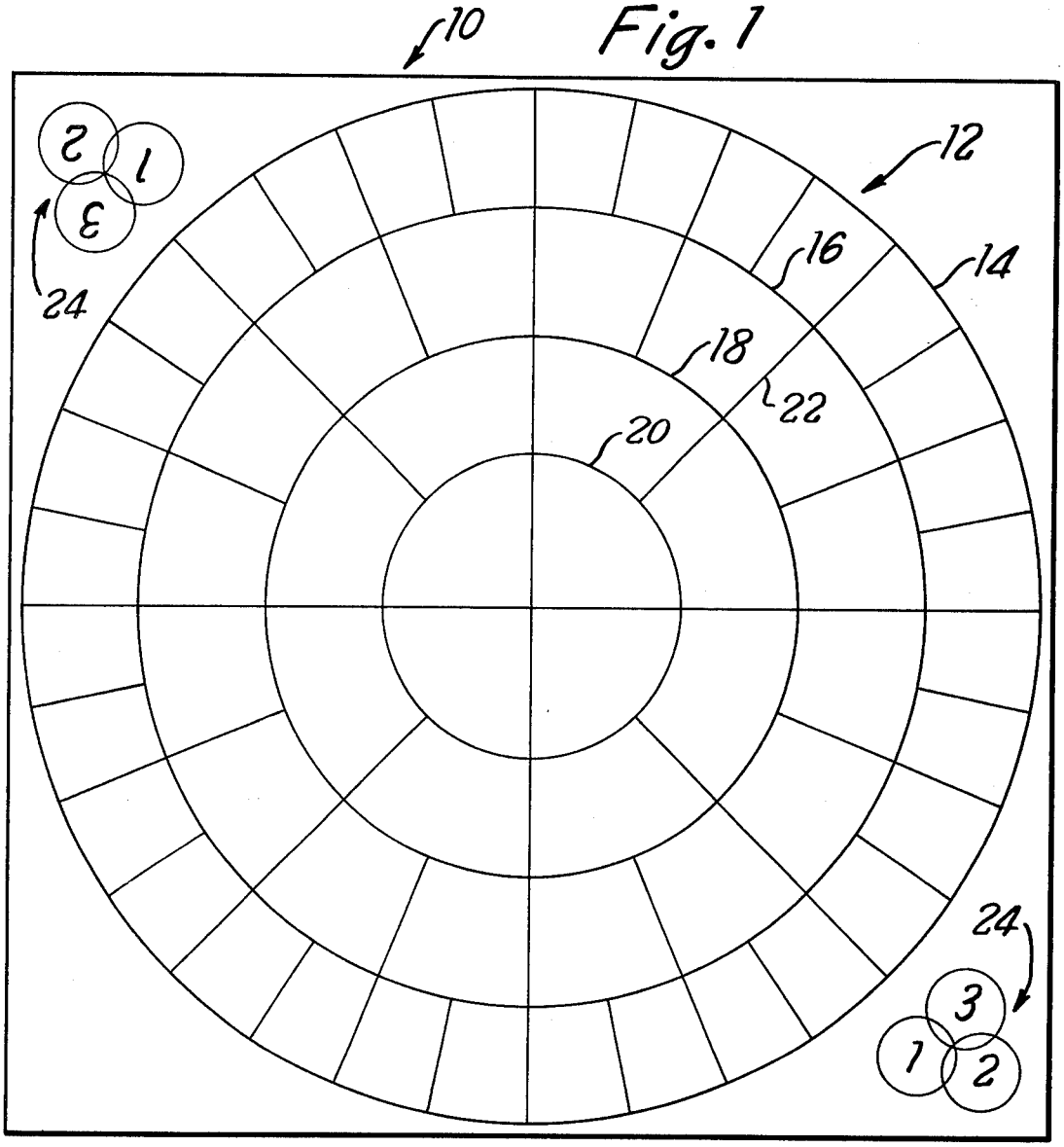
FIG. 1 shows a board on which the game is played.

The game is for two players, and is played on a rectangular board 10 as shown in FIG. 1. The board 10 may be of stiff cardboard or other suitable material faced with paper bearing the printed material described hereinbelow and may be constructed so that it may be folded in half when not in use.

A circular playing area 12, sub-divided into sixty playing spaces, is printed on the board 10. The playing spaces are defined by a circular boundary 14 of the playing area 12, by circles 16, 18 and 20 concentric with and of lesser diameter than the boundary 14, and by radii such as 22. Additionally, each player has to his right three non-playing areas or time-warp circles 24 numbered 1, 2 and 3, the circles and numbers being printed on the board 10.

The game is imaginary and futuristic, in that it is assumed that time has been conquered, and that there is a war between rival Time-Lords. Under their control two armies face each other not only in space, but also in time.

Figure 2:
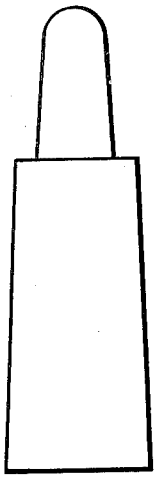
FIGS. 2 and 5 show elevations of four playing pieces, respectively.
Figure 3:
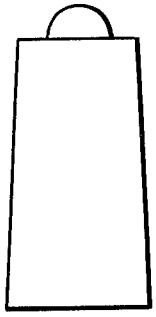
Figure 4:
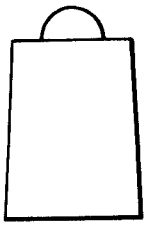
Figure 5:
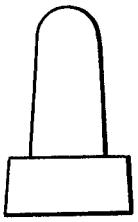
Figure 6:
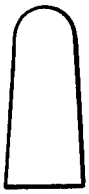
FIG. 6 shows a side elevation of a Time-Warp marker.

The playing pieces of the opposing armies are differently coloured, for example white and red. Each army comprises on Time-Lord T (FIG. 2), two Guardians G (FIG. 3), three Rangers R (FIG. 4) and six Warriers W (FIG. 5). As well as the above-listed playing pieces, each player also has one Time-Warp Marker M (FIG. 6).

The object of the game is to capture the enemy Time-Lord.

The values of the pieces are as follows. A Time-Lord can capture Guardians and Rangers. A Guardian can capture Rangers and Warriors. A Ranger can capture Warriors. Only a Warrior can capture the Time-Lord, so that if all the warriors of both sides are taken the game is a draw. Two similar pieces are neutral, that is to say a piece of one army having any particular value cannot capture a piece of the other army having the same value.

A player must move a piece in his turn. All pieces move in exactly the same way, that is one playing space in any direction other than diagonally. To put it slightly differently, a piece can move from any one of the sixty playing spaces within the playing area 12 to any adjacent playing space having an extended common boundary with the first-mentioned space.

Any piece, including a Time-Lord, can be placed in time-warp, whereupon the piece is removed from the playing area 12 by the player commanding it and placed in that one of that player's time-warp circles 24 labelled 1. In that player's subsequent turn the time-warped piece may either be returned to the playing area 12 or be moved to that one of that player's time-warp circles 24 labelled 2, and in a subsequent turn to the time-warp circle 24 labelled 3. In the next turn after reaching the time-warp circle 24 labelled 3 the piece must be returned to the playing area 12. If it cannot do so, because there are no available spaces, the piece is deemed to be captured.

When a player puts one of his playing pieces into time-warp, he places his Time-Warp Marker in the playing area on the playing space from which he removed the playing piece. When the piece is returned to the playing area, it must reappear on the space which it left, or up to two spaces (not diagonally) from that space. The Time-Warp Marker is then removed.

Figure 7:
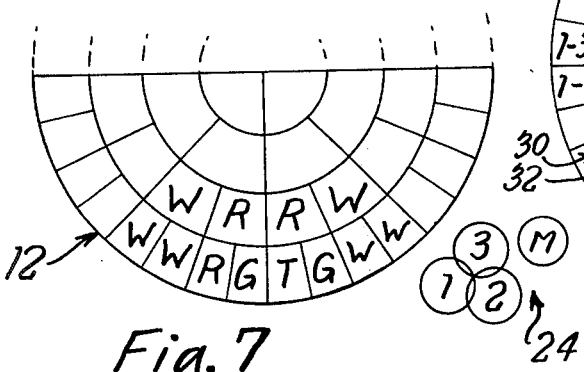
FIG. 7 shows the way in which each army of pieces is arranged initially.

The initial positions of the playing pieces of one of the two armies are as shown in FIG. 7. The initial positions of the playing pieces of the other army are symmetrical. Thus, the two Time-Lords are positioned adjacent to the vertical diameter of the playing area 12, but on opposite sides of it.

To start the game the player commanding the red army moves first. He can also time-warp a playing piece if he so wishes. It is then the opponent's turn. From this point on there are three actions possible in a player's turn, these being; a move, a return from time-warp and a time-warp. These actions can be done in any order, except that only one playing piece can be time-warped at any one time. A particular playing piece can only carry out one action in a turn. No two playing pieces can occupy the same space. Any piece playing can enter a space occupied by either Time-Warp Marker.

A move is obligatory, whereas a time-warp is optional. If a Time-Lord is in time-warp when all of the remaining pieces of its army have been captured, the Time-Lord is itself deemed to be captured since it cannot make a move.

A playing piece attacks by being on a playing space adjacent (but not diagonally adjacent) to a playing space occupied by any suitably valued opposing playing piece. The captured playing piece is removed from the playing area 12. However, a player is never obliged to capture an opposing piece if he does not wish to.

If a playing piece is moved on to a playing space adjacent to a playing space occupied by an opposing piece of superior value, it may be captured by the opponent before his normal turn, if he so chooses. Playing pieces can be captured by this method, or by a move, or by returning from time-warp. A single playing piece can only destroy one opposing playing piece by each method. Where a choice is available, the attacker selects his victims. When an action has been made and the piece released, the action cannot be redirected. The opponent's turn starts when all available actions have been completed, or declared completed in the case of a time-warp not being made.

The skill of time travel is in choosing the right moment for a playing piece to arrive and depart. For example, it is possible to reappear from time-warp in a playing space just vacated by a captured opposing playing piece in the same turn, i.e., provided that such piece is captured before the return from time-warp.

In practice, control of the centre of the playing area 12 is very important. Moreover, it is best to arrange playing pieces in groups so that they can support and protect each other.

An example of the options open to a player in a typical situation will now be described with reference to FIG. 8. First, however, the convention used to identify the playing spaces will be explained. Each space is identified by a pair of numbers separted by a hyphen. The first numbers denotes by taking the value 1, 2, 3 or 4 in which of three annular sections 30, 32, 34 and a circular section 36 of the playing area 12, respectively, the playing space is located. The second number indicates the location of the playing space within the denoted one of the sections 30, 32, 34 and 36. This is done by counting the playing spaces in the section in an anti-clockwise direction starting from the left-hand horizontal radius 38 of the playing area 12. To facilitate understanding of this convention, some of the playing spaces in FIG. 8 have their identities marked thereon.

Figure 8:
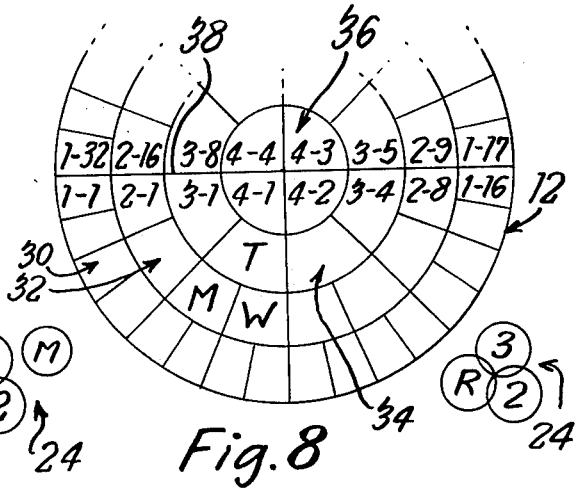
FIG. 8 indicates, for purposes of explanation, a possible stage in a game.

Applying the above-explained convention to FIG. 8, it will be seen that the player has his Time-Lord T in space 3-2 and has a Warrior W in space 2-4. He also has a Ranger R in the Time-Warp circle 24 labelled 1, the Ranger R having been moved from space 2-3 as indicated by the presence of the player's Time-Warp Marker M in space 2-3.

Referring to the situation shown in FIG. 8, supposing that the player during the course of his turn wishes to move the Warrior W, to return the Ranger R from time-warp, and to time-warp to Time-Lord T. The Warrior W can be moved to any of the playing spaces: 1-7, 1-8, 2-3 and 2-5. It can also be moved to space 3-2 if the Time-Lord T is first time-warped. The Ranger R can be moved from time-warp to any of the playing spaces: 1-3, 1-4, 1-5, 1-6, 1-7, 1-8, 2-1, 2-2, 2-3, 2-5, 3-1, 3-3 and 4-1. The Ranger R can also be moved from time-warp to space 2-4, but only if the Warrior W is first moved. Further, the Ranger R can be moved from time-warp to space 3-2, but only if the Time-Lord T is first moved. Since, however, the player wishes to time-warp his Time-Lord T, and this cannot be done while the Ranger R is in time-warp, the player will not wish to select this course of action.

As will be appreciated from the foregoing, there is a great flexibility in the options open to a player in a particular turn.

Figure 9:
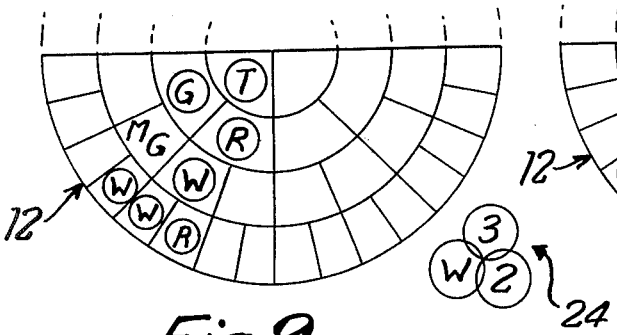
FIGS. 9 and 10 indicate the execution of a possible game-winning turn.
Figure 10:
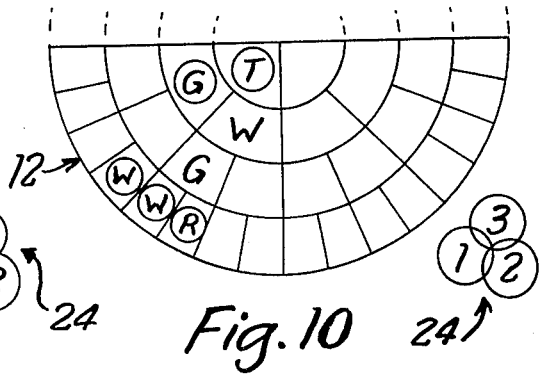

A typical game-winning turn will now be described with reference to FIGS. 9 and 10. At the start of the turn the pieces are disposed as shown in FIG. 9 and it is white's turn to play. To distinguish the white and red pieces, the latter are shown encircled. White will win if he: selects the red Warrior W on space 2-3 for capture by his Guardian G on space 2-2, the Guardian G therefore still being free to move; moves such Guardian G to space 2-3 and selects the red Ranger R on space 3-2 for capture; and removes his Warrior W from time-warp to space 3-2. (Removal of the Warrior W from time-warp is not impermissibly diagonal, since the Warrior W has reappeared two spaces from space 2-2, where the white Time-Warp Marker was located, via space 3-1 or space 2-3.) After this turn the pieces are disposed as shown in FIG. 10 and white has won in that the red Time-Lord T on space 4-1 can be captured by the white Warrier W on space 3-2. The red Guardian G on space 3-1 can do nothing to save the situation: although it could capture the white Warrier W on space 3-2 at the beginning of red's turn, this would be too late to save the red Time-Lord T.

Figure 11:
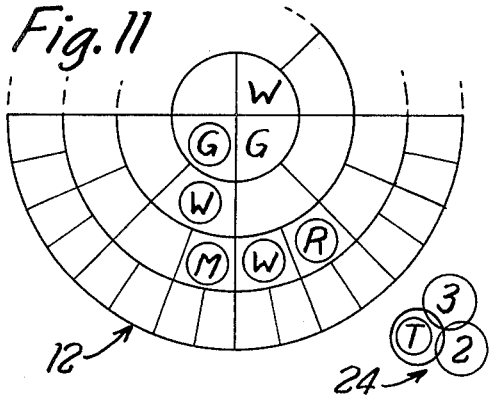
FIGS. 11 and 12 indicate execution of a hidden attack.
Figure 12:
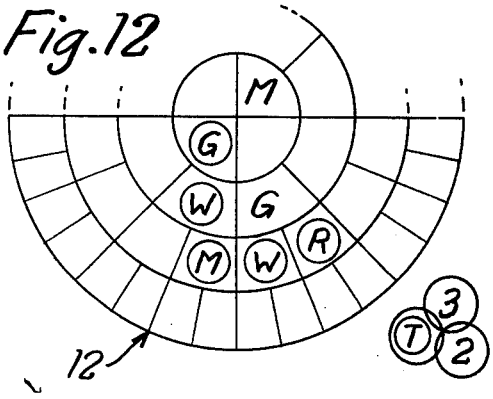

A hidden attack will now be described with reference to FIGS. 11 and 12. The pieces are disposed as shown in FIG. 11 and it is white's turn. Once again, white pieces are distinguished from red pieces by encirclement of the latter. Red has apparently protected all of his playing pieces by time-warping his Time-Lord T. If white moves his Guardian G from space 4-2 to space 3-3 and time-warps his Warrior W on space 4-3, removing any of red's playing pieces, red will remove his Time-Lord T from time-warp into the space vacated by the removed playing piece, capture the white Guardian G on space 3-3, and block the threat of the time-warped white Warrior W by moving a surviving piece on to space 3-3 vacated by the captured white Guardian G.

However, if the white Guardian G is moved to space 3-3 and does not capture a piece, the time-warped red Time-Lord T cannot successfully attack the white Guardian on space 3-3 due to the white Warrior W being in time-warp. One of the threatened red pieces has to be first moved away to enable the red Time-Lord T to attack, which stops red from making a move to space 3-3 afterwards to stop the white Warrior W from winning the game. Thus, red cannot save all three of his threatened pieces, but must lose one of them before the white Guardian G is moved or time-warped away. White has thus executed a successful attack, since he chose not to capture a red piece immediately the opportunity arose. This hidden form of attack is difficult for an inexperienced player to spot.

The above-described game may be modified within the scope of the invention. For instance, the time-warp circles 24 and the playing area 12 need not be printed on the board, but can, for instance, be inlaid. Also, the time-warp circles 24 need not be provided on the board 10, but may be separate therefrom.

We claim:

1. A board game for two players comprising a board having a playing area divided into playing spaces, said playing area having a substantially circular boundary and said playing spaces being defined by circles concentric with and of lesser diameter than said boundary and by radii of said circles and said boundary, two similar armies of playing pieces for positioning on said playing spaces and for movement about said playing area by the players whereby each player may take pieces of the other player's army, a non-playing area for each player, each non-playing area being adapted to accommodate a playing piece of that player, and a marker for each player, each marker being adapted to be accommodated on a playing space, whereby either player can move a playing piece of his army from a playing space of said playing area to his non-playing area and denote the playing space from which said playing piece was moved by positioning his marker on said playing space.

2. A board game according to claim 1, wherein each player is provided with a plurality of said non-playing areas.

3. A board game according to claim 2, wherein said non-playing areas forming each said plurality are arranged adjacent one another.

4. A board game according to claim 3, wherein said non-playing areas forming each said plurality are provided with markings in the form of successive numerals indicating an order in which the non-playing areas forming the plurality are to be used.

5. A board game according to claim 1, wherein said non-playing areas are provided on said board.

6. A board game according to claim 5, wherein said non-playing areas are disposed outside of said playing area.

7. A board game according to claim 6, wherein said board is substantially rectangular, said playing area is substantially circular, said non-playing area for one player is disposed adjacent a first corner of said board, and said non-playing area for the other player is disposed adjacent a second corner of said board diagonally opposite said first corner.

8. A board game according to claim 6, wherein said non-playing areas are substantially circular.

9. A board game according to claim 5, wherein said playing area and said non-playing areas are defined by printed indicia applied to said board.

10. board game for two players comprising a substantially rectangular board having a substantially circular playing area divided into playing spaces, two similar armies of playing pieces for positioning on said playing spaces and for movement about said playing area by the players whereby each player may take pieces of the other player's army, a non-playing area for each player provided on said board outside of said playing area, each non-playing area being adapted to accommodate a playing piece of that player, said non-playing area for one player being disposed adjacent a first corner of said board and said non-playing area for the other player being disposed adjacent a second corner of said board diagonally opposite said first corner, and a marker for each player, each marker being adapted to be accommodated on a playing space, whereby either player can move a player piece of his army from a playing space of said playing area to his non-playing area and denote the playing space from which said playing piece was moved by positioning his marker on said playing space.

11. A board game according to claim 10, wherein said non-playing areas are substantially circular.

* * * * *